US006833519B1

(12) United States Patent
Bruchmann

(10) Patent No.: US 6,833,519 B1
(45) Date of Patent: Dec. 21, 2004

(54) SWITCHING SYSTEM WITH A COMBINED SWITCHING AND BLOCKING DEVICE

(76) Inventor: Klaus Bruchmann, Am Oelberg 7a, D-96450 Coburg (DE)

( * ) Notice: Subject to any disclaimer, the term of this patent is extended or adjusted under 35 U.S.C. 154(b) by 0 days.

(21) Appl. No.: 10/031,941

(22) PCT Filed: Jul. 20, 2000

(86) PCT No.: PCT/EP00/06937

§ 371 (c)(1),
(2), (4) Date: May 13, 2002

(87) PCT Pub. No.: WO01/08179

PCT Pub. Date: Feb. 1, 2001

(30) Foreign Application Priority Data

Jul. 22, 1999 (DE) ..... 199 34 539
Jul. 22, 1999 (DE) ..... 299 12 859 U

(51) Int. Cl.[7] ..... H01H 9/20
(52) U.S. Cl. ..... 200/50.01; 200/50.12
(58) Field of Search ..... 200/50.01, 50.02, 200/50.03, 50.07, 50.11, 50.12, 50.19

(56) References Cited

U.S. PATENT DOCUMENTS

| | | | | |
|---|---|---|---|---|
| 1,348,208 A | | 8/1920 | Clay | |
| 1,556,823 A | | 10/1925 | Holmes | |
| 3,632,917 A | * | 1/1972 | Norden | 200/43.14 |
| 4,744,003 A | * | 5/1988 | Koslosky et al. | 361/656 |
| 5,686,708 A | * | 11/1997 | Spencer | 200/50.12 |
| 5,757,260 A | * | 5/1998 | Smith et al. | 337/186 |
| 6,448,515 B1 | * | 9/2002 | Rohmer et al. | 200/50.28 |

FOREIGN PATENT DOCUMENTS

| | | | |
|---|---|---|---|
| DE | 31 19 181 C1 | 11/1982 | H01H/73/34 |
| DE | 34 47 942 A1 | 2/1986 | H01H/85/58 |
| DE | 297 14 134 U1 | 10/1997 | |
| GB | 1085069 | 9/1967 | H01H/23/10 |
| WO | WO 86/06221 A1 | 10/1986 | H02B/1/18 |

OTHER PUBLICATIONS

English language version of International Search Report for PCT/EP00/06937, Nov. 2000.

* cited by examiner

*Primary Examiner*—Michael A Friedhofer
(74) *Attorney, Agent, or Firm*—Wood, Phillips, Katz, Clark & Mortimer

(57) ABSTRACT

A switching system comprises at least one fused switch unit (10) with a fuse link (20) which can be switched on and off, having a make switch and a break switch and a blocking apparatus, for keeping the circuit open. A combined switching and blocking apparatus (30) is provided, with a blocking element (32) having at least one blocking rod (33) for each fused switch unit (10) being mounted on an operating lever (31) of the switch. An interlocking element (35) having an opening (36) is provided for each fused switch unit (10) and can be switched to and fro in the fused switch unit (10) together with the associated fuse link (20). A blocking rod (33) can be inserted into the opening (36) in the interlocking element (35) only when the fuse link (20) is in its switched-on position. The operating lever (31) of the switch can be switched to close the circuit only when each blocking rod (33) can be inserted into the associated opening (36) in the interlocking element (35). A fuse link (20) cannot be moved to its switched-off position when the blocking rod (33) is inserted into the opening (36) in the interlocking element (35).

8 Claims, 2 Drawing Sheets

SWITCHING SYSTEM WITH A COMBINED SWITCHING AND BLOCKING DEVICE

This application is an application filed under 35 U.S.C. Sec. 371 as a national stage of international application PCT/EP00/06937, which was filed Jul. 20, 2000.

TECHNICAL FIELD

The invention relates to a switching system which has at least one fused switch unit with a fuse link which can be switched to and fro between a switched-on position and a switched-off position.

BACKGROUND OF THE INVENTION

Such a switching system furthermore has a switch for closing and interrupting the circuit of the electrical power system, as well as a switching and blocking apparatus which prevents the circuit from being closed by the switch.

The switch for closing and interrupting the circuit of the switching system is intended to make it possible to make contact with all the fuse links in the switching system without any current or voltage being applied, before the circuit of the overall system is closed. This prevents switching arcs from forming on the sensitive contacts of the fuse links, and increases the life of the fuse links.

A blocking apparatus is intended to prevent the circuit from being closed via the switch even though the fuse links are not all in their switched-on position, with the intention of preventing incorrect operations of the switching system, which can lead to the switching arcs mentioned above and to damage, in particular to the fuse link.

SUMMARY OF THE INVENTION

One object of the invention is to provide a switching system which precludes incorrect operation of the switching system in a manner which is particularly simple and cost-effective, while at the same time being very reliable.

The object is achieved by a switching system according to the invention.

According to the invention, a combined switching and blocking apparatus is provided in the switching system, with a blocking element having at least one blocking rod for each fused switch unit being mounted on an operating lever of the switch for closing and interrupting the circuit. Furthermore, an interlocking element having an opening is provided in each fused switch unit and is arranged in the fused switch unit such that it can always be switched to and fro together with the fuse link. Each blocking rod can be inserted into the opening in the associated interlocking element only when the associated fuse link is in its switched-on position; and the operating lever of the switch can be switched to close the circuit only when each of the blocking rods can be inserted into the opening in its associated interlocking element. A fuse link cannot be moved to the switched-off position when the associated blocking rod is inserted in the opening in the associated interlocking element. This is the case for all the fuse links whenever the operating lever of the switch is switched to close the circuit.

The refinement according to the invention of the combined switching and blocking apparatus automatically ensures that the circuit of the switching system cannot be closed unless all the fuse links in the fused switch units are in their switched-on position. At the same time, this ensures that, once the circuit has been closed by switching the operating lever of the switch, and hence of the combined switching and blocking apparatus, none of the fuse links can be switched from its switched-on position to the switched-off position.

Incorrect operations are thus one hundred percent precluded, with operation of the system being extremely simple by virtue of there being only one operating lever.

The switching system according to the invention may comprise just one fused switch unit. However, it preferably comprises a number of series-connected fused switch units.

The switching and blocking apparatus according to the invention is particularly applicable to switching systems having a number of fused switch units for a three-phase circuit. The fused switch units can in this case be mounted, in particular, on busbars.

The individual fused switch units may have different structural designs. For example, in one embodiment, the fuse link can be switched to and fro directly between the switched-on position and the switched-off position in the fused switch unit. In other embodiments, a fuse plug is provided for holding the fuse link, in which the fuse plug can either be switched to and fro directly between a switched-on position and a switched-off position or can be inserted into a switching rocker of a fused switch unit, which is in turn designed such that it can be switched to and fro.

The interlocking element can be mounted directly on the fuse link, but is preferably mounted on the fuse plug or on a switching rocker, so that standardized fuse links can be used without the interlocking element having to be manually released from the old fuse link and having to be mounted on the new one, when replacing the fuse link, or, in some circumstances, having to adopt complex measures to ensure that the fuse link is automatically connected to the interlocking element on replacement.

If there is a switching rocker, then the interlocking element is preferably integral with the switching rocker, in order to achieve a simple system design.

The interlocking element is preferably in the form of a guide element, which defines and monitors the switching movement of the fuse link and/or of the fuse plug or of the switching rocker, in order to ensure a uniform and exact switching process.

The interlocking element preferably has at least one latching apparatus, which engages with corresponding latching elements in the fused switch unit, when the fuse link is in the switched-off position and/or the switched-on position. The limit positions of the fuse link and/or of the fuse plug or of the switching rocker are thus fixed as defined, latched limit positions.

BRIEF DESCRIPTION OF THE DRAWINGS

These and further advantages of the invention are evident from the attached schematic drawings, in which.

DETAILED DESCRIPTION OF THE PREFERRED EMBODIMENT

Figure 1:
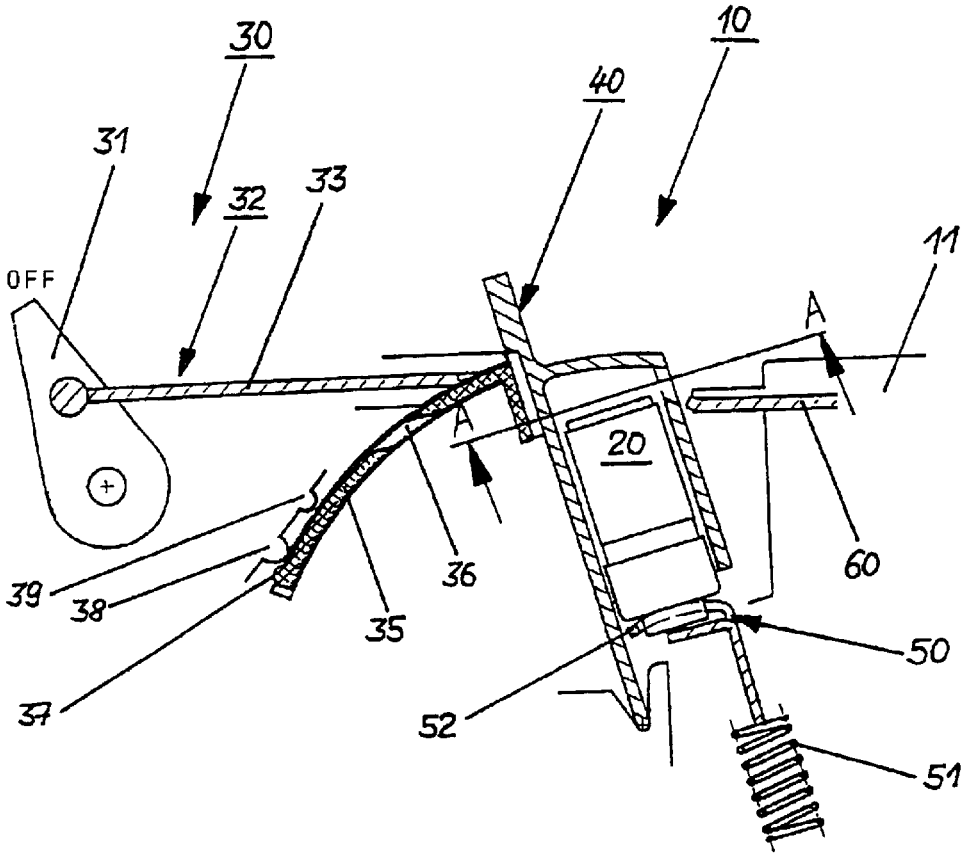
FIG. 1 shows a cross-sectional view through an area element of one embodiment of the switching system according to the invention, with a fuse link in the switched-off position.

FIG. 1 shows an area element of one embodiment of the switching system according to the invention, which comprises a number of fused switch units 10. However, for simplicity, only one area element of a single fused switch unit is shown. The other fused switch units are constructed analogously.

The fused switch unit 10 has a fuse plug 40, into which a fuse link 20 is inserted. A lower contact 50 makes contact with the fuse link 20 irrespective of the position of the fuse plug 40, while an upper contact 60 does not make contact with the fuse link 20 when the fuse plug 40 is in the switched-off position shown in FIG. 1.

The lower contact 50 of the fused switch unit 10 is preloaded by means of a spring 51, thus making a sliding contact 52, in the form of a fork, with the fuse link 20 at all times. The upper contact 60 makes contact with a mating contact on the fuse link 20 only when the fuse plug 40 is pivoted (see FIG. 2).

An interlocking element 35, which is in the form of a segment of a circle, is fitted to the fuse plug 40, is at the same time in the form of a guide and supporting element, and is guided in a guide rail (not shown) on the housing 11 of the fused switch unit 10.

The fuse plug 40 can be inserted into the fused switch unit 10 and can be removed from it, while the interlocking element 35 is a fixed component of the fused switch unit 10. The connection between the two elements will be explained in the following text in conjunction with FIG. 3.

The interlocking element 35 has an opening 36 into which a blocking rod 33 of the blocking element 32 of the switching and blocking apparatus 30 can be inserted when the fuse plug is in its switched-on position. However, when the fuse link 20 and the fuse plug 40 are in the switched-off position shown in FIG. 1, the blocking rod 33 of the switching and blocking apparatus 30 abuts against an edge area of the interlocking element 35, so that the operating lever 31 of the switching and blocking apparatus 30 cannot be switched.

The blocking rod 33 is part of the blocking element 32, with the blocking element having further blocking rods (not shown), which branch out, for further fused switch units. The blocking element is produced from a rigid material, thus avoiding distortion of the blocking element.

A latching element 37 of the interlocking element 35 engages with a corresponding latching element 38 on the fused switch unit 10, so that the switched-off position shown in FIG. 1 represents a latched limit position of the fuse plug 40 together with the fuse link 20.

Figure 2:
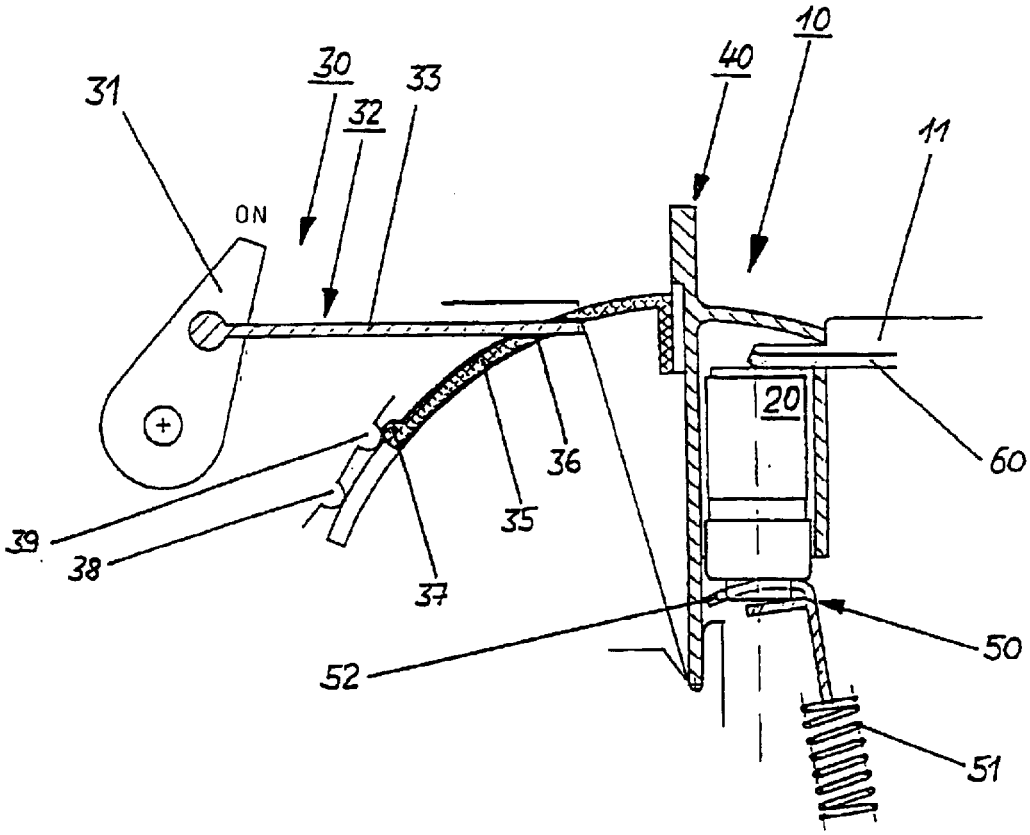
FIG. 2 shows the embodiment of the switching system illustrated in FIG. 1, with the fuse link in the switched-on position.

In FIG. 2, the fuse plug 40 together with the fuse link 20 is in its switched-on position. The fuse link 20 is now in contact with both the lower contact 50 and the upper contact 60 of the fused switch unit 10.

When the fuse plug 40 is pivoted to the switched-on position, the position of the interlocking element 35 also changes. The opening 36 in the interlocking element 35 is aligned with the blocking rod 33 of the switching and blocking apparatus 30, so that the operating lever 31 can be moved to a switched-on position, as a result of which the circuit of the switching system is closed. The pivoting of the operating lever 31 at the same time results in the blocking rod 33 being inserted into the opening 36 in the interlocking element. The dimensions of the blocking rod 33 correspond to those of the opening 36 in the interlocking element 35, so that the insertion process takes place with an accurate fit, and the fuse plug 40 together with the fuse link 20 cannot be pivoted out of the switched-on position.

The latching element 37 of the interlocking element 35 engages with a second latching element 39 on the fused switch unit so that this ensures that the fuse plug 40 has a latched limit position, irrespective of the position of the operating lever 31 and of the blocking of the fuse plug 40 by the blocking rod 33 in the switched-on position.

Since the blocking element 32 together with in each case one blocking rod 33 for each fused switch unit 10 is a rigid element, the operating lever cannot be moved to the position shown in FIG. 2 if even only one of the fuse plugs 40 is not in its switched-on position.

Figure 3:
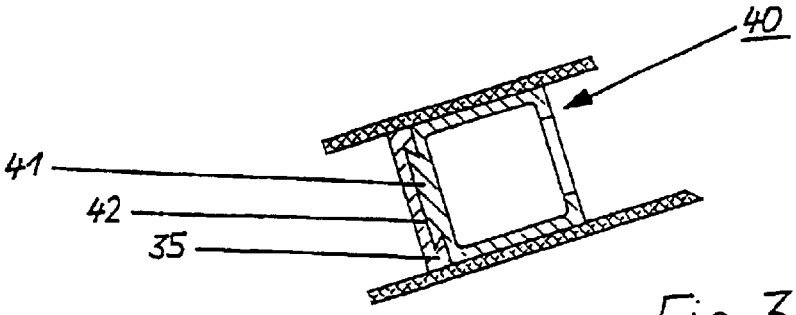
FIG. 3 shows a cross-sectional view along the line A—A in FIG. 1.

FIG. 3 shows a cross section through the fuse plug 40 and the interlocking element 35 along the line A—A in FIG. 1. The fuse plug 40 has an attachment element 41 in the form of a dovetail, which engages in a corresponding mating element 42 on the interlocking element 35, thus producing a positively locking connection, with a friction fit. The fuse plug 40 can thus easily be inserted from above into the fused switch unit 10, with a reliable connection between the fuse plug 40 and the interlocking element 35 automatically being ensured via the attachment element 41 and the mating element 42.

It shall be mentioned once again that the illustrated drawings are only schematic, so that no restrictions with regard to the dimensions and size ratios of the illustrated elements can be derived from them. Other geometric embodiments of the illustrated elements may be used without departing from the subject matter of the present invention.

What is claimed is:

1. A switching system, having:

at least one fused switch unit (10) with a fuse link (20) which can be switched to and fro between a switched-on position and a switched-off position, a switch for closing and interrupting the circuit of the switching system, said switch having an operating lever (31), a combined switching and blocking apparatus (30) which can prevent the circuit from being closed by the switch, said combined switching and blocking apparatus (30) including a blocking element (32) having at least one blocking rod (33) for said fused switch unit (10), said blocking rod (33) being mounted on said operating lever (31) of said switch for closing and interrupting the circuit, an interlocking element (35) having an opening (36) is provided for said fused switch unit (10) and arranged in said fused switch unit (10) such that said interlocking element (35) can be switched to and fro together with said fuse link (20), and so that (A) said blocking rod (33) can be inserted into the opening (36) in said interlocking element (35) only when said fuse link (20) is in said switched-on position, (B) said operating lever (31) of the switch can be switched to close the circuit only when said blocking rod (33) can be inserted into said opening (36) in said interlocking element (35), and (C) said fuse link (20) cannot be moved to its switched-off position when said blocking rod (33) is inserted in said opening (36) in said interlocking element (35).

2. The switching system as claimed in claim 1, wherein said fused switch unit (10) has a fuse plug (40) for holding the fuse link (20), and the fuse plug (40) can be switched to and fro between a switched-on position and a switched-off position.

3. The switching system as claimed in claim 2, wherein said interlocking element (35) is mounted on the fuse plug (40).

4. The switching system as claimed in claim 1, wherein a said fused switch unit (10) has a switching rocker for holding said fuse link (20) or said fuse plug (40), and the switching rocker can be switched to and fro between a switched-on position and a switched-off position.

5. The switching system as claimed in claim 4, wherein said interlocking element (35) is mounted on said switching rocker.

6. The switching system as claimed in claim 4, wherein said interlocking element (35) is integral with said switching rocker.

7. The switching system as claimed in claim 1, wherein said interlocking element (35) is in the form of a guide element.

8. The switching system as claimed in claim 1, wherein said interlocking element (35) has at least one latching element (37) which engages with a corresponding latching element (38, 39) on said fused switch unit (10) when at least one of said fuse link (20) and said fuse plug (40) are in the switched-off position and/or in the switched-on position.

* * * * *